US005406312A

United States Patent [19]

Arimoto

[11] Patent Number: 5,406,312

[45] Date of Patent: Apr. 11, 1995

[54] SEMICONDUCTOR INTEGRATED CIRCUIT AND DISPLAY APPARATUS

[75] Inventor: Akiya Arimoto, Itami, Japan

[73] Assignee: Mitsubishi Denki Kabushiki Kaisha, Tokyo, Japan

[21] Appl. No.: 196,509

[22] Filed: Feb. 15, 1994

[30] Foreign Application Priority Data

Feb. 26, 1993 [JP] Japan ..... 5-037873
Dec. 24, 1993 [JP] Japan ..... 5-327778

[51] Int. Cl.[6] ..... G09G 3/02

[52] U.S. Cl. ..... 345/205; 345/211; 345/55

[58] Field of Search ..... 345/205, 206, 204, 211, 345/30, 32, 33, 46, 52, 55, 82, 87; 359/54, 55

[56] References Cited

U.S. PATENT DOCUMENTS 4,740,165 4/1988 Tomino et al. ..... 345/104
4,812,837 3/1989 Shiraishi et al. ..... 345/204

FOREIGN PATENT DOCUMENTS 1225996 9/1989 Japan ..... 345/205

*Primary Examiner*—Alvin E. Oberley
*Assistant Examiner*—Doon Chow
*Attorney, Agent, or Firm*—Oblon, Spivak, McClelland, Maier & Neustadt

[57] ABSTRACT

The evenness of the brightness of a display apparatus is enhanced. A drive control signal generation circuit supplies drive control signals to drive circuits, respectively. Drive power source input pads are connected to each other by a drive power source line in a chip, and provided with potentials from the same power source outside the chip. The drive circuits respectively comprise drive circuit input terminals which are connected at predetermined intervals to the drive power source line. Under the control of the drive control signals, the drive circuits transmit potentials received at the drive circuit input terminals to drive signal output pads, respectively. A difference in drive output impedance between the drive signal output pads is thereby suppressed.

10 Claims, 14 Drawing Sheets

SEMICONDUCTOR INTEGRATED CIRCUIT AND DISPLAY APPARATUS

BACKGROUND OF THE INVENTION

1. Field of the Invention

The present invention relates to a semiconductor integrated circuit. More particularly, the present invention relates to a semiconductor integrated circuit which comprises a drive control signal output circuit for driving a display element and a display apparatus which comprises the display element.

2. Description of the Prior Art

FIG. 12 is a circuitry diagram showing connections between a light emitting diode array 2 and a conventional semiconductor integrated circuit 200 which drives the same. The light emitting diode array 2 is comprised of eight light emitting diodes 3*a*, 3*b*, . . . , 3*h*. Cathode electrodes of the light emitting diodes are commonly connected to a cathode of a drive power source 6 at a terminal 4. Anode electrodes of the light emitting diodes 3*a*, 3*b*, . . . , 3*h* are independent of each other and are respectively connected to drive signal output terminals 5*a*, 5*b*, . . . , 5*h* of the semiconductor integrated circuit 200. A drive power source input terminal 7 of the semiconductor integrated circuit 200 is connected to an anode of the drive power source 6.

FIG. 13 is a block diagram showing an inner structure of a chip 8 of the semiconductor integrated circuit 200. The chip 8 includes drive signal output pads 10*a*, 10*b*, . . . , 10*h* and a drive power source input pad 14 which are respectively connected to the drive signal output terminals 5*a*, 5*b*, . . . , 5*h* and the drive power source input terminal 7 within the semiconductor integrated circuit 200.

The chip 8 also includes a drive control signal generation circuit 13 and drive circuits 9*a*, 9*b*, . . . , 9*h*. The drive control signal generation circuit 13 outputs drive control signals 11*a*, 11*b*, . . . , 11*h* which respectively control the drive circuits 9*a*, 9*b*, . . . , 9*h*. From the power source input pad 14 on a drive power source line 15, potentials are supplied to the drive circuits 9*a*, 9*b*, . . . , 9*h* respectively at drive circuit input terminals 12*a*, 12*b*, . . . , 12*h*, and the drive circuits 9*a*, 9*b*, . . . , 9*h* transmit the potentials to the drive signal output pads 10*a*, 10*b*, . . . , 10*h*, respectively.

The light emitting diodes 3*a*, 3*b*, . . . , 3*h* of the light emitting diode array 2 each emit light in accordance with the drive control signals 11*a*, 11*b*, . . . , 11*h* as shown in FIGS. 12 and 13.

It is to be noted here that the drive power source line 15 has a resistance component as a wire resistance. Hence, drive output impedances of the drive signal output pads 10*a*, 10*b*, . . . , 10*h* are each equal to a sum of the ON-resistance of each of the drive circuits 9*a*, 9*b*, . . . , 9*h* and the wire resistance the drive power source line 15 has within the chip 8.

FIG. 14 is a block diagram showing the resistance component the drive power source line 15 has within the chip 8. The drive power source line 15 includes a wire resistance 19*a* at a portion thereof which is located between the drive power source input pad 14 and the drive circuit input terminal 12*a* of the drive circuit 9*a* which is disposed closest to the drive power source input pad 14, and a wire resistance 19*b* at a portion which is located thereof between the drive circuit input terminal 12*a* of the drive circuit 9*a* and the drive circuit input terminal 12*b* of the drive circuit 9*b*. In this manner, wire resistances 19*c*, 19*d*, . . . 19*h* are disposed.

If the drive output circuits 9*e* and 9*f* have the same ON-resistance, a difference in drive impedance between the drive signal output pads 10*e* and 10*f*, for instance, which are seated adjacent each other within the chip 8 is equal to the resistance value of the wire resistance 19*f* which exists on the drive power source line 15 at a portion between the drive circuit input terminals 12*e* and 12*f*. Since a difference in drive impedance between any adjacent drive signal output pads is not large and drive output impedance differences among any adjacent pairs of the drive signal output pads are approximately the same, there is no chance that the display state of the diode array 2 will be extremely unnatural.

However, even within the same chip 8, the closest drive signal output pad to the drive power input pad 14 has the lowest drive output impedance, and progressively farther drive signal output pads have progressively higher drive output impedances. More precisely, the wire resistances 19*a*, 19*b*, . . . , 19*h* are formed in series between the drive power source input pad 14 and the drive circuit input terminal 12*h* of the farthest drive signal output pad 9*h* from the drive power source input pad 14. Due to this, if the drive output circuits 9*a* and 9*h* have the same ON-resistance within the semiconductor integrated circuit 200, the drive output impedance with respect to the drive signal output terminal 5*h* is larger than the drive output impedance with respect to the drive signal output terminal 5*a* by a sum of the resistance values of the wire resistances 19*b*, . . . , 19*h*. As a result, a large difference in brightness is created between the brightest light emitting diode 3*a* and the darkest light emitting diode 3*h*, with the brightness of the interposing light emitting diodes gradually decreasing.

This is particularly disadvantageous where a plurality of the semiconductor integrated circuits 200 are used together with an increased number of diodes within the light emitting diode array in order to realize a finer display. FIG. 15 is a circuitry diagram showing connections between a light emitting diode array 291 which consists of sixteen light emitting diodes 3*a*, 3*b*, . . . , 3*p* and two semiconductor integrated circuits 200*a* and 200*b* which control the light emitting diode array 291. Each of the semiconductor integrated circuits 200*a* and 200*b* includes the chip 8, the drive signal output terminals 5*a*, 5*b*, . . . , 5*h* and the drive power source input terminal 7 which are shown in FIG. 13, and operate similarly to the semiconductor integrated circuit 200.

The semiconductor integrated circuit 200*b* control eight light emitting diodes 3*a* to 3*h* while the semiconductor integrated circuit 200*a* control eight light emitting diodes 3*i* to 3*p*. If the light emitting diode array consists of a larger number of light emitting diodes, one or more additional drive integrated circuits are disposed depending on a need to drive the light emitting diode array.

The adjacent light emitting diodes 3*h* and 3*i* which are driven by different semiconductor integrated circuits are taken as an example. The light emitting diode 3*h* is connected to the drive output terminal 5*h* which has the highest drive output impedance within the semiconductor integrated circuit 200*b*, whereas the light emitting diode 3*i* is connected to the drive output terminal 5*a* which has the lowest drive output impedance within the semiconductor integrated circuit 200*a*. Hence, the brightness of the light emitting diode array 291 shows an abrupt change between these adjacent diodes, which is quite unnatural as a display.

SUMMARY OF THE INVENTION

A semiconductor integrated circuit comprising: (a) at least one pair of power source terminals which has first and second power source terminals; (b) a plurality of output terminals; (c) a power source line disposed in correspondence to the pair of the power source terminals so as to connect the first and second power source terminals to each other which belong to the same pair of power source terminals; (d) a plurality of drive circuits disposed in correspondence to the output terminals, the drive circuits each having an input terminal and an output terminal which is connected to each of the output terminals, the number of Input terminals of each drive circuit being equal to the number of drive power source lines, the drive circuits each receiving at least one drive control signal which controls connection between the input terminal and the output terminal of each drive circuit, and (e) a drive control signal generation circuit for receiving a control signal and providing the drive control signal to the drive circuits based in accordance with the control signal, wherein in each semiconductor integrated circuit, the input terminals of the drive circuits are connected at predetermined intervals to the drive power source line.

The drive circuits each preferably include a transistor which comprises: (d-1) a first current electrode which is connected to the input terminal of each of the drive circuits; (d-2) a second current electrode which is connected to the output terminal of each of the drive circuits; and (d-3) a control electrode for receiving the drive control signal.

Alternatively, the drive power source line has: (c-1) a first length between the first power source terminal and one of contact points which is the nearest to the first power source terminal, the contact points being points at which the input terminals of the drive circuits are connected to the drive power source line; and (c-2) a second length between the second power source terminal and one of contact points which is closest to the second power source terminal, and (c-3) a difference between the first and the second lengths is not more than 100 $\mu$m.

There may be a plurality of pairs of power source terminals provided in the semiconductor integrated circuit. The number of control signals given to each drive circuit is preferably equal to the number of drive power source lines.

The present invention is also directed to a display apparatus which comprises: (a) a plurality of semiconductor integrated circuits each comprising: (a-1) at least one pair of power source terminals which has first and second power source terminals; (a-2) a plurality of output terminals; (a-3) a power source line disposed in correspondence to the pair of the power source terminals so as to connect first and second power source terminals to each other which belong to the same pair of power source terminals; (a-4) a plurality of drive circuits disposed in correspondence to the output terminals, the drive circuits each having an input terminal and in output terminal which is connected to each of the output terminals, the number of input terminals of each circuit being equal to the number of drive power source lines, the drive circuits each receiving at least one drive control signal which controls a connection between the input terminal and the output terminal of each of the drive circuits; and (a-5) a drive control signal generation circuit for receiving a control signal and providing the drive control signal to the drive circuits in accordance with the control signal, in each of the semiconductor integrated circuits, the input terminals of the drive circuits are connected at predetermined intervals to the drive power source line, (b) an array of display elements, the number of display elements being greater than the number of output terminals of each semiconductor integrated circuit, each display element having first and second terminals and operating in response to a potential difference between the first and second terminals; and (c) a voltage source having first and second terminals, the first and second power source terminals being connected in common to the first terminal of the voltage source, the second terminals of the display elements being connected in common to the second terminal of the voltage source.

The display apparatus may comprise only a single voltage source, and the first and second power source terminals of each semiconductor integrated circuit may be connected in common to the first terminal of the voltage source.

One of the output terminals of a first one of the semiconductor integrated circuits which is closest to the first power source terminal of the first one of the semiconductor integrated circuits and one of the output terminals of a second one of the semiconductor integrated circuits which is closest to the second power source terminal of the second one of the semiconductor integrated circuits may be connected to the first terminals of two adjacent display elements of the display elements, respectively.

A display apparatus according to another aspect comprises: (a) a plurality of first semiconductor integrated circuits each comprising: (a-1) at least one pair of power source terminals which has first and second power source terminals; (a-2) a plurality of output terminals; (a-3) a power source line disposed in correspondence to the pair of power source terminals so as to connect the first and second power source terminals to each other which belong to the same pair of power source terminals; (a-4) a plurality of drive circuits disposed in correspondence to the output terminals, the drive circuits each having an input terminal and an output terminal which is connected to each of the output terminals, the number of input terminals of each drive circuit being equal to the number of the drive power source line, the drive circuits each receiving at least one drive control signal which controls a connection between the input terminal and the output terminal of each of the drive circuits; and (a-5) a drive control signal generation circuit for receiving a control signal and providing the drive control signal to the drive circuits in accordance with the control signal, in each of the first semiconductor integrated circuits, the input terminals of the drive circuits are connected at predetermined intervals to the drive power source line, (b) a display element having first terminals and second terminals and operating in response to a potential difference between the first and second terminals, the number of second terminals being greater than the number of output terminals of one of the first semiconductor integrated circuits; (c) a voltage source having first and second terminals, the first and the second power source terminals of the first semiconductor integrated circuits being connected in common to the first terminal of the voltage source; and (d) an electrode drive circuit connected to the second terminal of the voltage source, the electrode drive circuit controlling a potential which is given to the first terminal of the display element, wherein the first terminals of the display element are exclusively connected to the output terminals of the first semiconductor integrated circuits.

The display apparatus preferably further comprises (e) a plurality of second semiconductor integrated circuits each comprising: (e-1) at least one pair of power source terminals which has first and second power source terminals; (e-2) a plurality of output terminals; (e-3) a power source line disposed in correspondence to the pair of the power source terminals so as to connect the first and second power source terminals to each other which belong to the same pair of power source terminals; (e-4) a plurality of drive circuits disposed in correspondence to the output terminals, the drive circuits each having an input terminal and an output terminal which is connected to each of the output terminals, the number of input terminals of each drive circuit being equal to the number of drive power source lines, the drive circuits each receiving at least one drive control signal which controls a connection between the input terminal and the output terminal of each one of the drive circuits; and (e-5) a drive control signal generation circuit for receiving a control signal and providing the drive control signal to the drive circuits in accordance with the control signal, in each one of the second semiconductor integrated circuits, the input terminals of the drive circuits are connected at predetermined intervals to the drive power source line, wherein the number of second terminals of the display element is greater than the number of output terminals of one of the second semiconductor integrated circuits, and the second terminals of the display element are exclusively connected to the output terminals of the second semiconductor integrated circuits.

Thus, in the semiconductor integrated circuit according to the present invention, since potentials are supplied from the same power source to a pair of the power source terminals, the drive output impedance at the output terminal of the drive circuit which is connected to the power source line closest to the first power source terminal would not be largely different from the drive output impedance at the output terminal of the drive circuit which is connected to the power source line closest to the second power source terminal.

When a plurality of pairs of power source terminals are provided, a potential to be given to the output terminals of the drive circuits can be switched among a plurality of levels.

In the display apparatus according to a first aspect of the present invention, the semiconductor integrated circuits prevent potentials which are given to the first terminals of driven display elements of the array from becoming largely different from each other.

In the display apparatus according to a second aspect of the present invention, the first semiconductor integrated circuits prevent potentials which are given to the first terminals of the display element which are to be driven from becoming largely different from each other.

By increasing the number of the second semiconductor integrated circuits in particular, potentials which are given to the second terminals of the display element which are to be driven are prevented from becoming largely different from each other.

Thus, in the semiconductor integrated circuit according to the present invention, connection of the output terminals of the semiconductor integrated circuit and the display element having the first terminals enhances the evenness of a display of the display element.

The display apparatus according to the present invention realizes a far more even display.

Accordingly, it is an object of the present invention to offer a semiconductor integrated circuit which achieves an enhanced evenness in display of a display clement and to offer a display apparatus which has a uniform distribution of display light intensity.

These and other objects, features, aspects and advantages of the present invention will become more apparent from the following detailed description of the present invention when taken in conjunction with the accompanying drawings.

DESCRIPTION OF THE PREFERRED EMBODIMENTS

Preferred Embodiment 1

Figure 1:
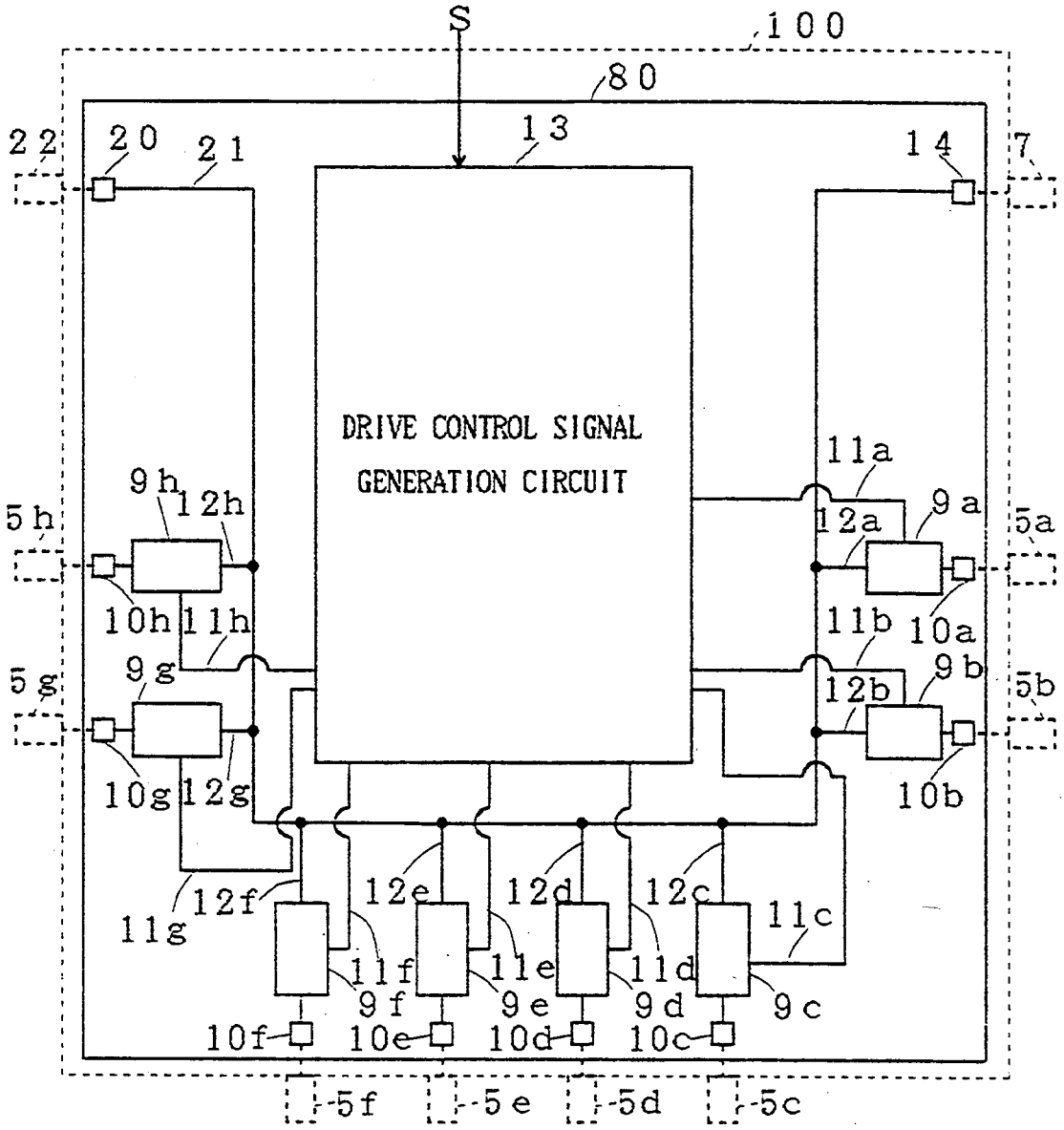
FIG. 1 is a block diagram explaining a first preferred embodiment of the present invention.

FIG. 1 is a block diagram showing a structure of a chip 80 of a semiconductor integrated circuit 100 according to a first preferred embodiment of the present invention. The chip 80 includes a drive control signal generation circuit 13 and drive circuits *9a, 9b, . . . , 9h.* The drive control signal generation circuit 13 receives a control signal S and outputs drive control signals *11a, 11b, . . . , 11h* which are controlled by the control signal S respectively to the drive circuits *9a, 9b, . . . , 9h.*

The chip 80 also includes drive power source input pads 14 and 20. As described later, potentials supplied to the two drive power source input pads are available from the same power source. The drive power source input pads 14 and 20 are connected to each other by a drive power source line 21 within the chip 80. The drive circuits *9a, 9b, . . . , 9h* have drive circuit input terminals *12a, 12b, . . . , 12h,* respectively, which are connected at predetermined intervals to the drive power source line 21.

The drive circuits 9a, 9b, 9c, . . . , 9h transmit potentials which are received at the drive circuit input terminals 12a, 12b, . . . , 12h respectively to drive signal output pads 10a, 10b, . . . , 10h under the control of the drive control signals 11a, 11b, . . . , 11h.

As comparison between the conventional chip 8 and the chip 80 shows, the chip 80 is equal to the conventional chip 8 which is modified so as to include the drive power source input pad 20 and to have the drive power source line 15 extended from the drive circuit input terminal 12h to the drive power source input pad 20 to become the drive power source line 21.

Though comprising the drive signal output terminals 5a, 5b, . . . , 5h and the drive power source input terminal 7 similarly to the semiconductor integrated circuit 200, the semiconductor integrated circuit 100 additionally comprises a drive power source input terminal 22. Within the semiconductor integrated circuit 100, the drive signal output terminals 5a, 5b, . . . , 5h are connected to the drive signal output pads 10a, 10b, . . . , 10h of the chip 80, respectively, while the drive power source input terminals 7 and 22 are connected to the drive power source input pads 14 and 20, respectively, both by wire bonding or other appropriate means.

Figure 2:
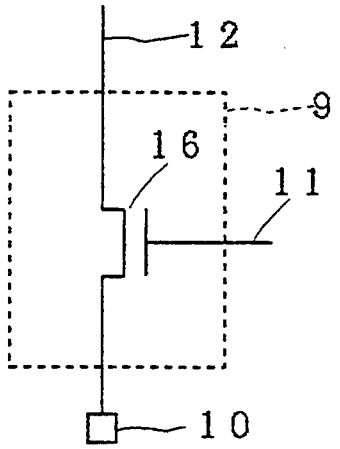
FIG. 2 is a circuitry diagram showing a structure of a drive circuit.

FIG. 2 is a circuitry diagram showing a structure of a drive circuit 9 (which typically represents the drive circuits 9a to 9h). The drive circuit 9 may be formed by a MOS transistor 16. A drain of the MOS transistor 16 is connected as an output of the drive circuit 9 to a drive signal output pad 10 (which typically represents the drive signal output pads 10a to 10h) while a source of the MOS transistor 16 is connected to a drive circuit input terminal 12 (which typically represents the drive circuit input terminals 12a to 12h). A drive control signal 11 (which typically represents the drive control signals 11a to 11h) is supplied to a gate of the MOS,transistor 16. The MOS transistor 16 may be either P-type or N-type, or may be a bipolar transistor or a junction type FET, or may be a combination of these.

Figure 3:
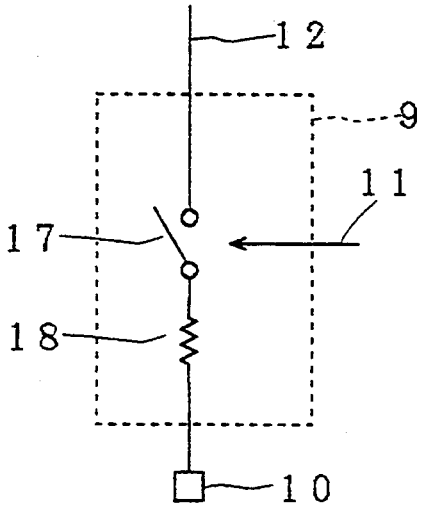
FIG. 3 is a circuitry diagram showing an equivalent circuit of the drive circuit.

FIG. 3 is a circuitry diagram showing an equivalent circuit of the circuit shown in FIG. 2. A switch circuit 17 ant a resistor 18 are connected in series between the drive circuit input terminal 12 and the drive signal output pad 10. The switch 17 is opened and closed in response to the drive control signal 11. The resistor 18 corresponds to the ON-resistance of the MOS transistor 16.

When the MOS transistor 16 is controlled by the drive control signal 11 received from the drive control signal generation circuit 13 so as to turn on, the drive circuit 9 transmits a potential which is received at the drive circuit input terminal 12 through the ON-resistance 18 to the drive signal output pad 10. When the MOS transistor 16 is controlled so as to turn off, the drive signal output pad 10 assumes an electrically open state.

Figure 4:
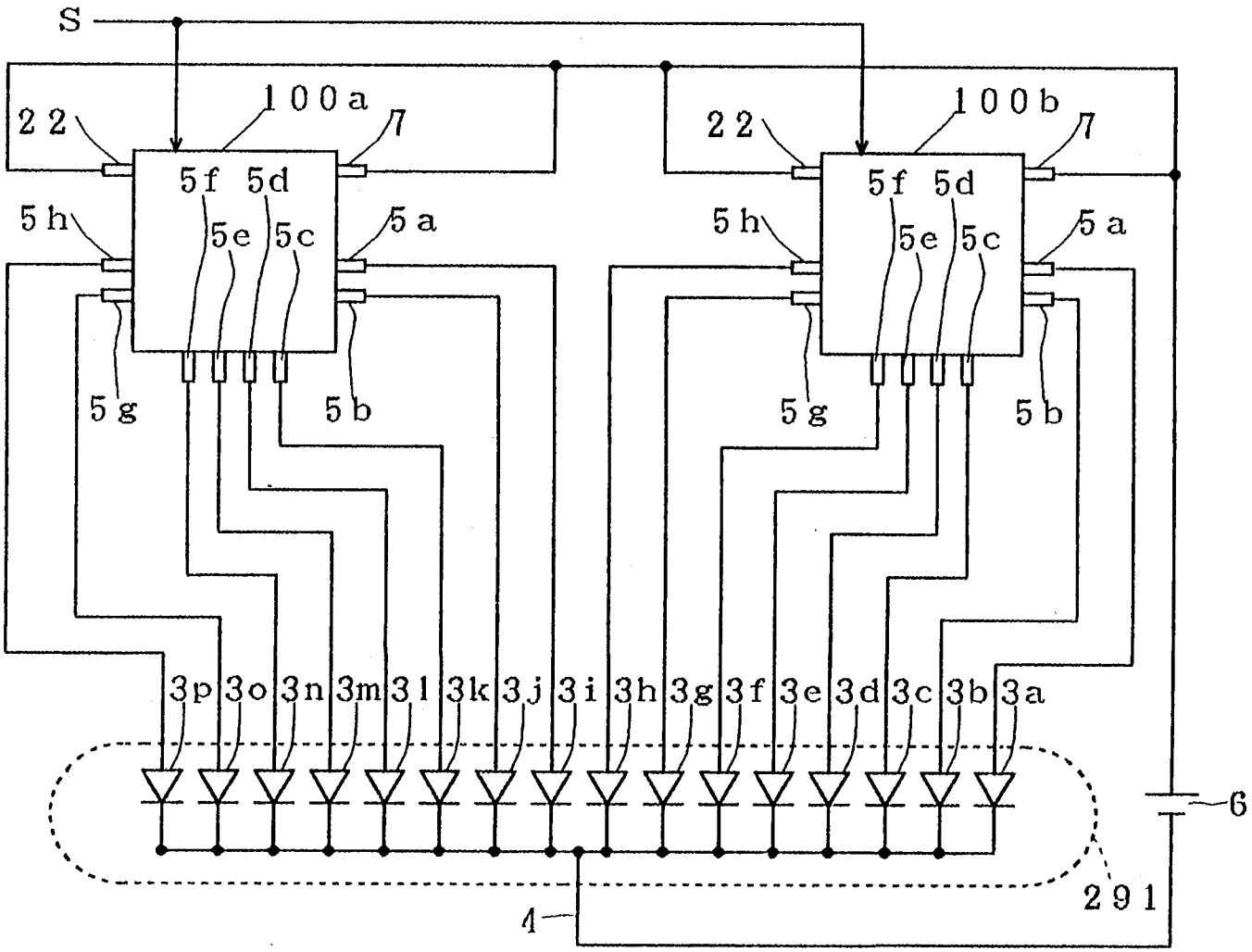
FIG. 4 is a circuitry diagram explaining the first preferred embodiment of the present invention.

FIG. 4 is a circuitry diagram showing connections between two semiconductor integrated circuits 100a and 100b, each structured the same as the semiconductor integrated circuit 100 of FIG. 1, and the light emitting diode array 291 which consists of the sixteen light emitting diodes 3a, 3b, . . . , 3p. The light emitting diode array 291 is driven and controlled by the semiconductor integrated circuits 100a and 100b.

The drive power source input terminals 7 and 22 of each of the semiconductor integrated circuits 100a and 100b are connected to the anode of the drive power source 6. At the terminal 4, cathode electrodes of sixteen light emitting diodes 3a, 3b, . . . , 3p are connected in common to the cathode of the drive power source 6.

Anode electrodes of the eight light emitting diodes 3a to 3h are connected to the drive signal output terminals 5a to 5h of the semiconductor integrated circuit 100b, respectively. Anode electrodes of the other eight light emitting diodes 3i to 3p are connected to the drive signal output terminals 5a to 5h of the semiconductor integrated circuit 100a, respectively. Hence, the respective light emitting diode elements of the light emitting diode array 291 are independently controlled in their emission of light. By appropriately selecting the light emitting diode elements, the light emitting diode array 291 can display various features.

Figure 5:
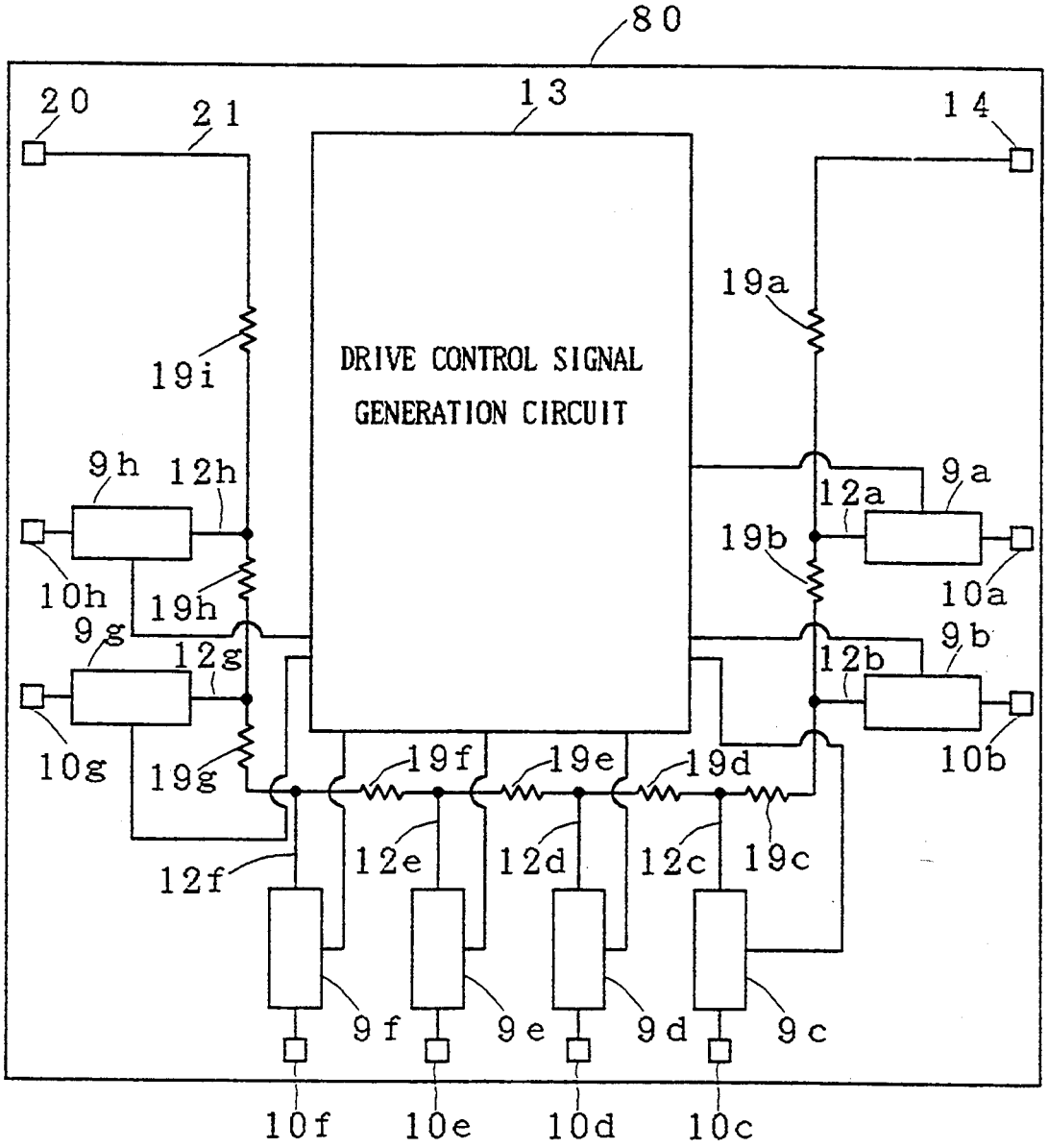
FIG. 5 is a block diagram explaining the first preferred embodiment of the present invention.
Figure 14:
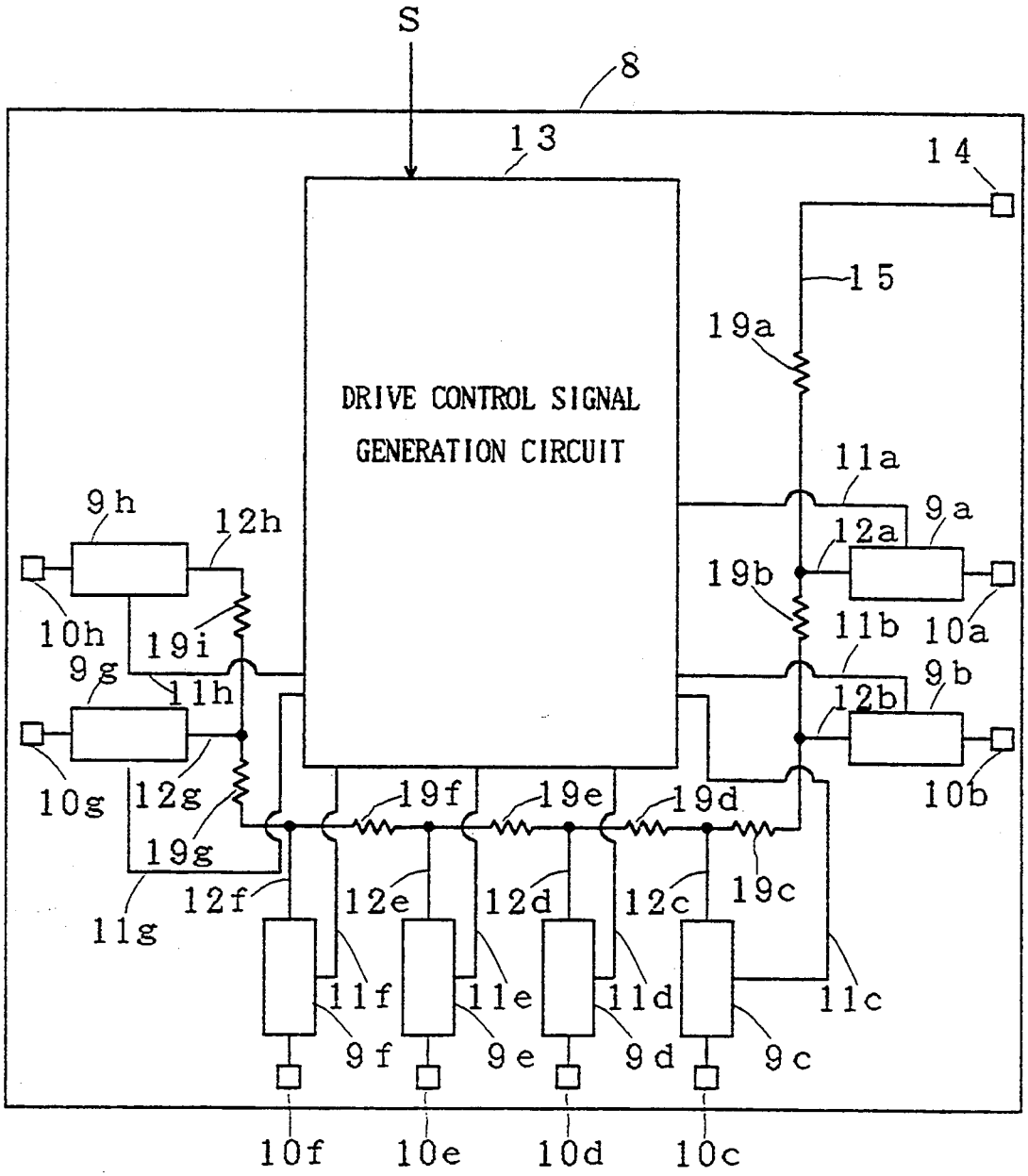
FIG. 14 PRIOR ART
Figure 15:
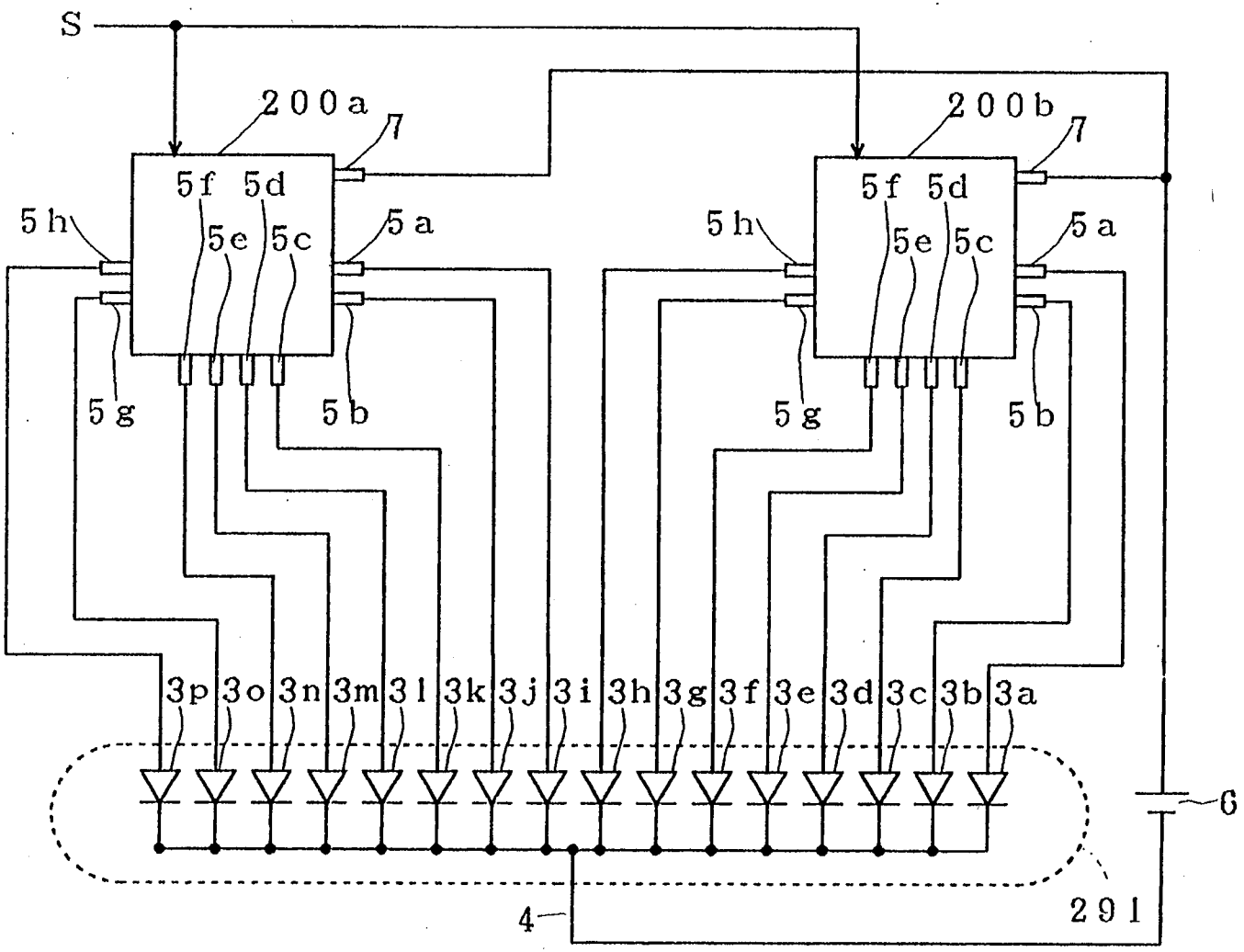
FIG. 15 PRIOR ART
FIG. 15 is a circuitry diagram showing the conventional technique.

FIG. 5 is a block diagram showing a resistance component the drive power source line 21 has within the structure of FIG. 1. Similar to the conventional structure (FIG. 14), the drive power source line 21 includes wire resistances 19a to 19h between adjacent ones of the drive power source input pad 14 and the drive circuit input terminals 12a to 12h. In addition to this, a wire resistance 19i exists between the drive circuit input terminal 12h and the drive power source input pad 20.

While the wire resistance between the drive power source input pad 14 and the drive circuit input terminal 12h amounts to as large as a sum of the resistance values of the wire resistances 19a to 19h in the conventional structure, the wire resistance between the drive power source input pad 14 and the drive circuit input terminal 12h is as small as approximately the resistance value of the wire resistance 19i according to the present invention. Hence, even between the drive signal output pads 10a and 10h which are most largely spaced apart from each other, a difference in drive output impedance is kept low.

This prevents a large difference in brightness between the light emitting diode 3h which is connected to the drive output terminal 5h of the semiconductor integrated circuit 100b and the light emitting diode 3i which is connected to the drive output terminal 5a of the semiconductor integrated circuit 100a, as shown in FIG. 4. Hence, an abrupt change in brightness of the light emitting diode array 291 between adjacent diodes and a resulting unnatural display are prevented. In other words, the evenness of a display is enhanced.

In general, an aluminum vacuum-evaporated wire having a thickness of about 1 $\mu$m is used as a drive power source line in a semiconductor integrated circuit. Since the conductivity rate of aluminum is about $3\times10^{-8}$ $\Omega$·m, if the aluminum wire has a thickness of 1 $\mu$m and a width of 10 $\mu$m, the wire resistance value per millimetter of the drive power source line is around 3 $\Omega$. On the other hand, since the distance between adjacent drive circuit is approximately the same as the interval between the drive signal output pads, i.e., 100 to 200 $\mu$m, the wire resistance value of the drive power source line taken between adjacent drive circuits is around 0.3 to 0.6 $\Omega$. Hence, as far as the resistance components alone are concerned, while the difference in drive output impedance between the drive signal output pads 10a and 10h is around 2 to 4 $\Omega$ in the conventional structure, the difference in drive output impedance is suppressed to a very small value in the present invention.

The quality of the display is improved particularly when the output impedances of the drive signal output terminals 5a to 5h are set at the same value. That is, if the wire resistances 19a and 19i have approximately the same resistance value, a far more even display is attained.

To this end, it is necessary in the layout of FIG. 1 that the length of the wire connecting the drive power source input pad 14 and the drive circuit input 12*a* is approximately equal to the length of the wire connecting the drive power source input pad 20 and the drive circuit input 12*h*. It is difficult to ensure that the two wires have precisely the same length. However, since the aluminum wire has a thickness of about 1 μm and a width of about 10 μm in general, if a difference between the two lengths is not more than 100 μm, the resistance value remains approximately equal to or less than 0.3 Ω. Thus, the evenness of the display is enhanced in fact.

Preferred Embodiment 2

Figure 6:
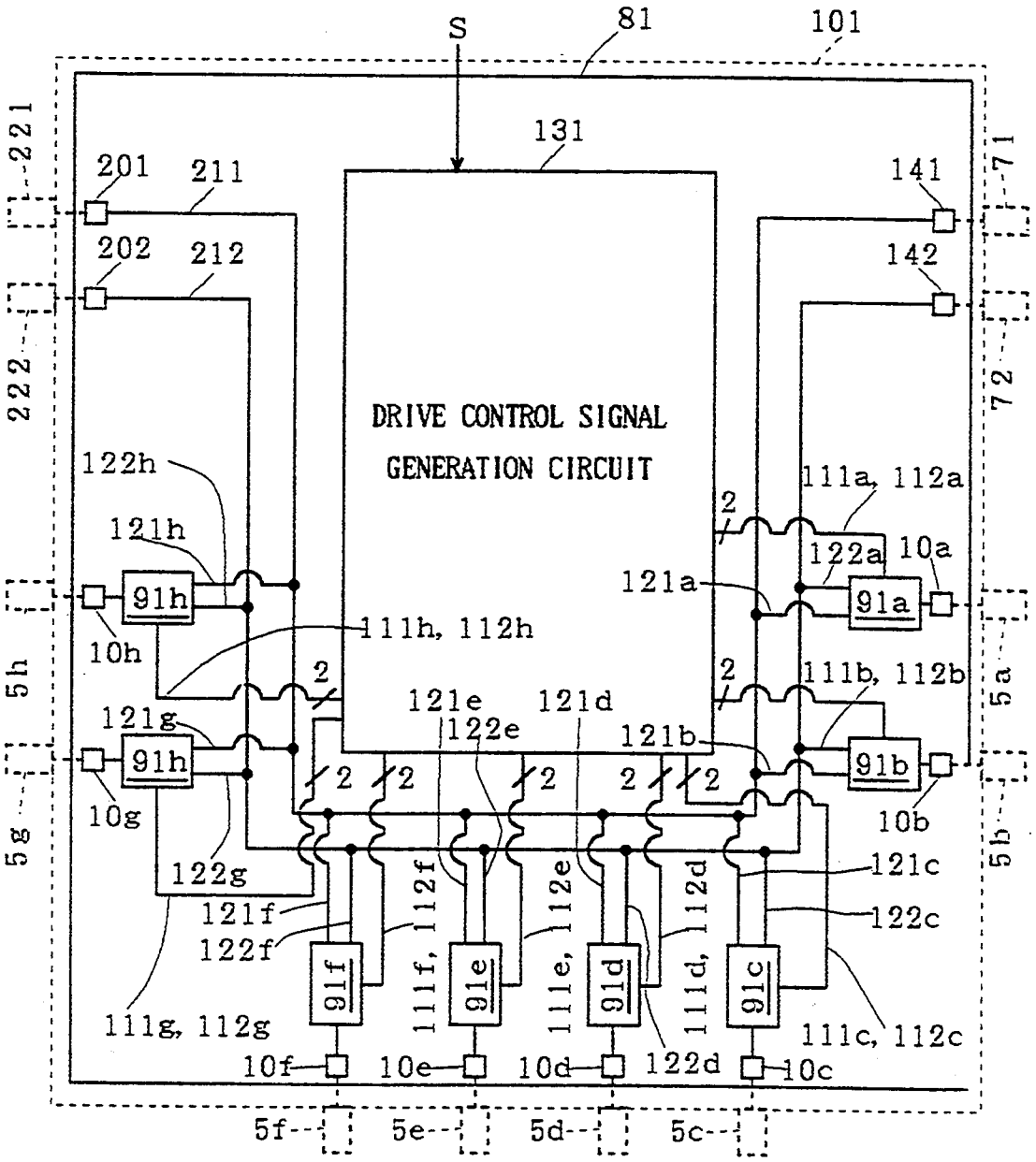
FIG. 6 is a block diagram explaining a second preferred embodiment of the present invention.

FIG. 6 is a block diagram showing a structure of a chip 81 of a semiconductor integrated circuit 101 according to a second preferred embodiment of the present invention. The chip 81 includes a drive control signal generation circuit 131 and drive circuits 91*a*, 91*b*, . . . . , 91*h*. The drive control signal generation circuit 131 receives a control signal S and outputs pairs of outputs drive signals (111*a*, 112*a*), (111*b*, 112*b*), . . . , (111*h*, 112*h*) to the drive circuits 91*a*, 91*b*, . . . , 91*h*, respectively.

The chip 81 includes two pairs of drive power source input pads (141, 201) and (142, 202). As described later, potentials are supplied from the same power source to the drive power source input pads which form the pairs. Within the chip 81, the drive power source input pads 141 and 201 are connected to each other by a drive power source line 211. Similarly, the drive power source input pads 142 and 202 are connected to each other by a drive power source line 212 within the chip 81. The drive circuits 91*a*, 91*b*, . . . , 91*h* include pairs of drive circuit input terminals (121*a*, 122*a*), (121*b*, 122*b*) . . . , (121*h*, 122*h*), respectively. The drive circuit input terminals 121*a*, 121*b*, . . . , 121*h* are connected at predetermined intervals to the drive power source line 211 while the drive circuit input terminals 122*a*, 122*b*, . . . , 122*h* are connected at predetermined intervals to the drive power source line 212.

Under the control of the pairs of the drive control signals (111*a*, 112*a*), (111*b*, 112*b*), . . . , (111*h*, 112*h*), the drive circuits 91*a*, 91*b*, . . . , 91*h* connect the pairs of the drive circuit input terminals (121*a*, 122*a*), (121*b*, 122*b*) . . . , (121*h*, 122*h*) to the drive signal output pads 10*a*, 10*b*, . . . , 10*h*, respectively.

Comparison between the chip 80 of the first preferred embodiment and the chip 81 shows that the chip 81 is equal to the chip 80 which is modified so that the drive power source input pads 14 and 20 are replaced with the pairs of the drive power source input pads (141, 201) and (142, 202) and the drive power source line 21 is replaced with the pair of the drive power source lines 211 and 212.

Similarly to the semiconductor integrated circuit 100 of the first preferred embodiment, the semiconductor integrated circuit 101 comprises the drive signal output terminals 5*a*, 5*b*, . . . , 5*h* which are respectively connected to the drive signal output pads 10*a*, 10*b*, . . . , 10*h* of the chip 81 within the semiconductor integrated circuit 101. However, in the semiconductor integrated circuit 101, instead of the drive power source input terminals 7 and 22 of the semiconductor integrated circuit 100, pairs of drive power source input terminals (71, 72) and (221, 222) are disposed, respectively. Within the semiconductor integrated circuit 101, the drive power source input terminals 71, 72, 221 and 222 are connected to the drive power source input pads 141, 142, 201 and 222, respectively.

If the semiconductor integrated circuit 101 having such a structure is used, it is possible to realize a more complex display than the display attained in the first preferred embodiment, e.g., a display with a gradation, by providing different potentials or currents to display elements which are connected to the semiconductor integrated circuit 101.

Figure 7:
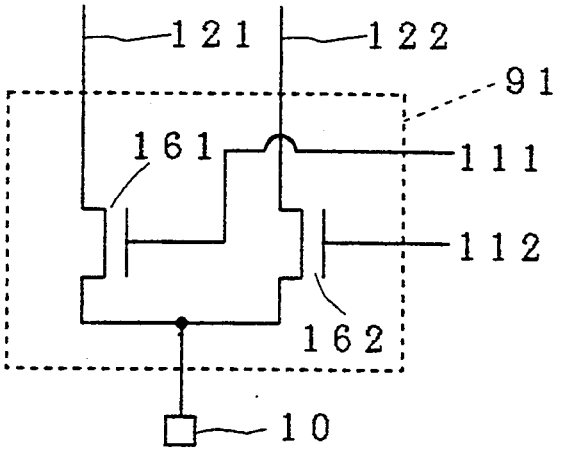
FIG. 7 is a circuitry diagram showing a structure of a drive circuit.

FIG. 7 is a circuitry diagram showing a structure of a drive circuit 91 (which typically represents the drive circuits 91*a* to 91*h*). The drive circuit 91 may be formed by a pair of MOS transistors 161, 162. Drains of the MOS transistors 161 and 162 are connected in common as an output of the drive circuit 91 to the drive signal output pad 10. A source of the MOS transistor 161 is connected to a drive circuit input terminal 121 (which typically represents the drive circuit input terminals 121*a* to 121*h*) and a source of the MOS transistor 162 is connected to a drive circuit input terminal 122 (which typically represents the drive circuit input terminals 122*a* to 122*h*). Gates of the MOS transistors 161 and 162 are provided with a drive control signal 111 (which typically represents the drive control signals 111*a* to 111*h*) and a drive control signal 112 (which typically represents the drive control signals 112*a* to 112*h*). Hence, the drive control signal 111 controls whether to connect the drive circuit input terminal 121 to the drive signal output pad 10 while the drive control signal 112 controls whether to connect the drive circuit input terminal 122 to the drive signal output pad 10.

Figure 8:
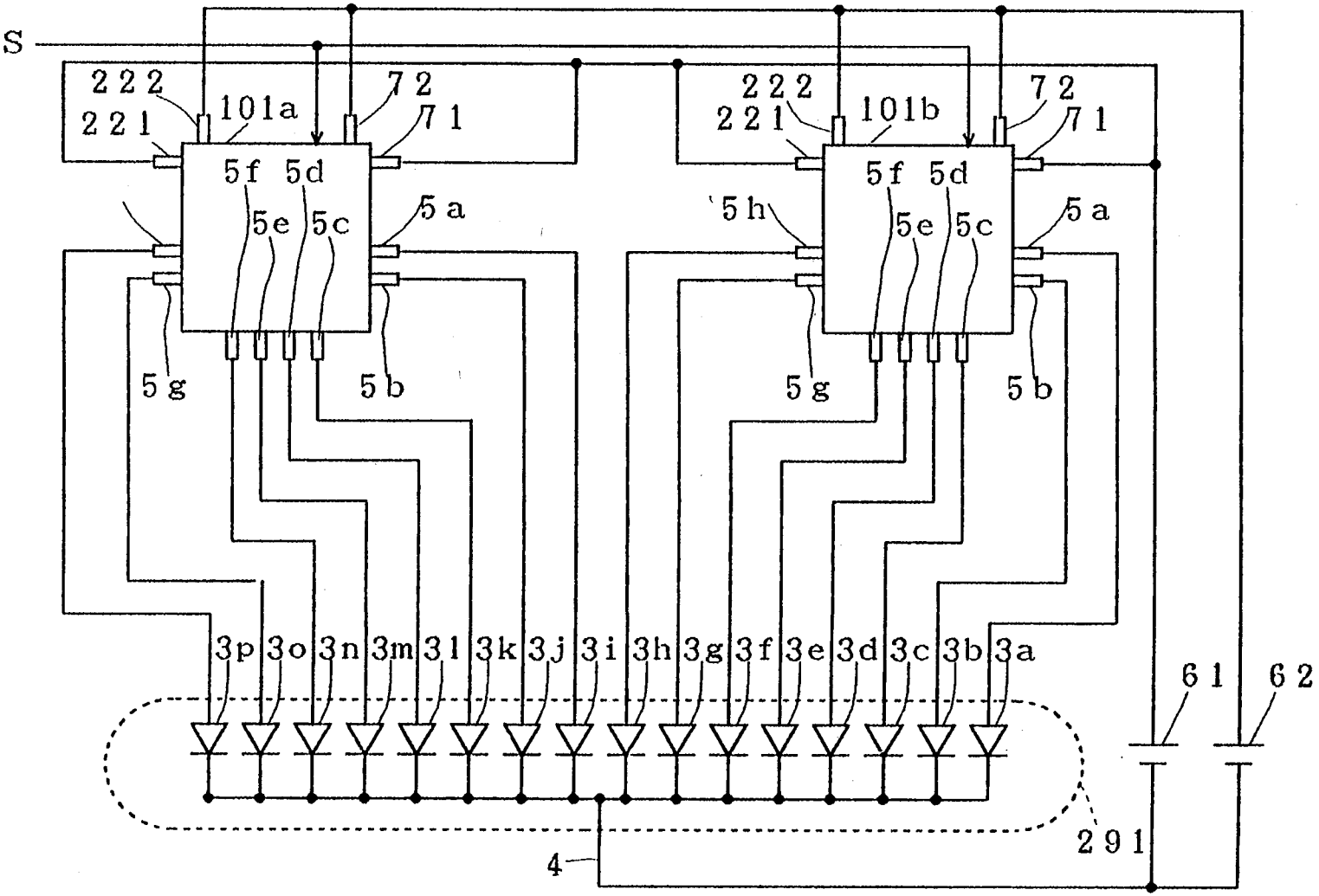
FIG. 8 is a circuitry diagram explaining the second preferred embodiment of the present invention.

FIG. 8 is a circuitry diagram showing where semiconductor integrated circuits 101*a* and 101*b* each equipped with the chip 81 and therefore having the same structure as the semiconductor integrated circuit 101 are used in combination with two types of drive power sources 61 and 62 so as to display a feature with the light emitting diode array 291.

An anode of the drive voltage source 61 is connected to drive both power source input terminals 71 and 221 of the semiconductor integrated circuits 101*a* and 101*b*. In a similar manner, an anode of the drive voltage source 62 is connected to drive both power source input terminals 72 and 222 of the semiconductor integrated circuits 101*a* and 101*b*. The drive power sources 61 and 62 supply potentials of different levels, and the cathode electrodes of the sixteen light emitting diodes 3*a*, 3*b*, . . . , 3*p* are connected in common to cathodes of the drive power sources 61 and 62 through the terminal 4. Similar to the first preferred embodiment, the anode electrodes of the sixteen light emitting diodes 3*a* to 3*p* are connected to the drive signal output terminals 5*a* to 5*h* of the two semiconductor integrated circuits 101.

Thus, different potentials are supplied to the pair of the drive power source terminals (71, 221) and the pair of the drive power source terminals (72, 222) so that the drive control signal generation circuit 131 generates two types of drive control signals, whereby it is possible that the sixteen light emitting diodes 3*a*, 3*b*, . . . , 3*p* emit with different brightness. In addition, since the mutual connections between the drive power source 61, the drive power source terminal 71, the drive power source input pad 141, the drive power source line 211, the drive power source input pad 201 and the drive power source terminal 221 and the mutual connections between the drive power source 62, the drive power source terminal 72, the drive power source input pad 142, the drive power source line 212, the drive power source input pad 202 and the drive power source terminal 222 are the same as the mutual connections between the drive power source 6, the drive power source terminal 7, the drive power source input pad 14, the drive power source line 21, the drive power source input pad 20 and the drive power source terminal 22, the evenness of the display is enhanced as in the first preferred embodiment.

Preferred Embodiment 3

The application of the present invitation is not limited to a current-drive type display element such as a light emitting diode. Rather, the present invention is applicable to a voltage-drive type display element such as a liquid crystal display element.

Figure 9:
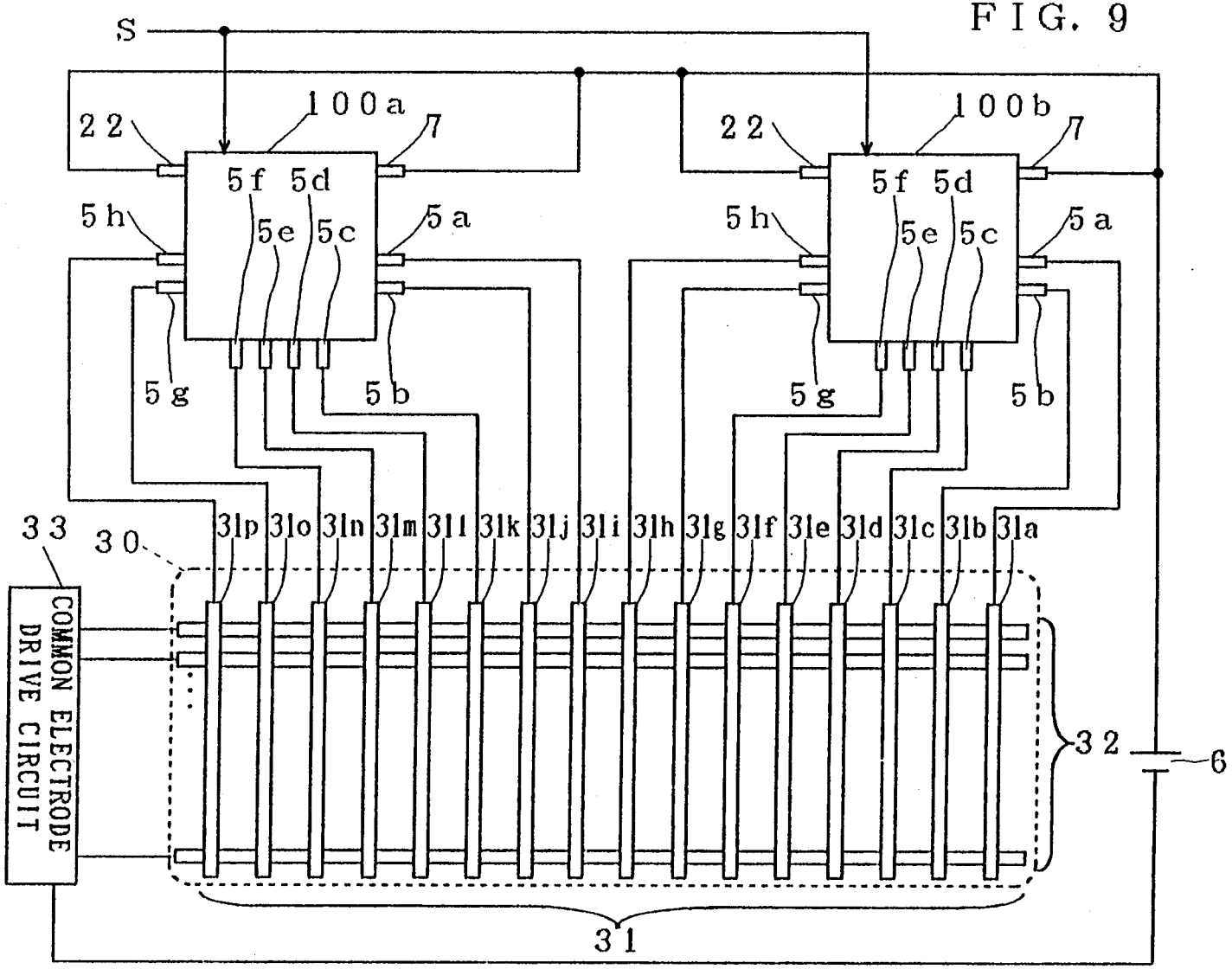
FIGS. 9 to 11 are circuitry diagrams explaining a third preferred embodiment of the present invention.

FIG. 9 is a circuitry diagram showing semiconductor integrated circuits 100*a* and 100*b* each having the: same structure as the semiconductor integrated circuit 100 which are used to display a feature with a liquid crystal display element 30.

The liquid crystal display element 30 comprises a segment electrode group 31 and a common electrode group 32 which is connected to a common electrode drive circuit 33. Connected to a cathode of a drive voltage source 6, the common electrode drive circuit 33 supplies a plurality of predetermined potentials to the common electrode group 32.

The drive power source terminals 7 of each of semiconductor integrated circuits 100*a* and 100*b* are connected to the anode of the drive power source 6. The semiconductor integrated circuits 100*a* and 100*b* each receive the control signal S in accordance with which of the potentials of the segment electrode group 31 are being controlled.

The segment electrode group 31 consists of segment electrodes 31*a*, 31*b*, . . . , 31*p*. The segment electrodes 31*a*, 31*b*, . . . , 31*h* are connected to the drive signal output terminals 5*a*, 5*b*, . . . , 5*h* of the semiconductor integrated circuit 100*b* so that the potentials at the segment electrodes 31*a*, 31*b*, . . . , 31*h* are controlled. The segment electrodes 31*i*, 31*j*, . . . , 31*p* are connected to the drive signal output terminals 5*a*, 5*b*, . . . , 5*h* of the semiconductor integrated circuit 100*a* so that the potentials at the segment electrodes 31*i*, 31*j*, . . . , 31*p* are controlled.

Figure 10:
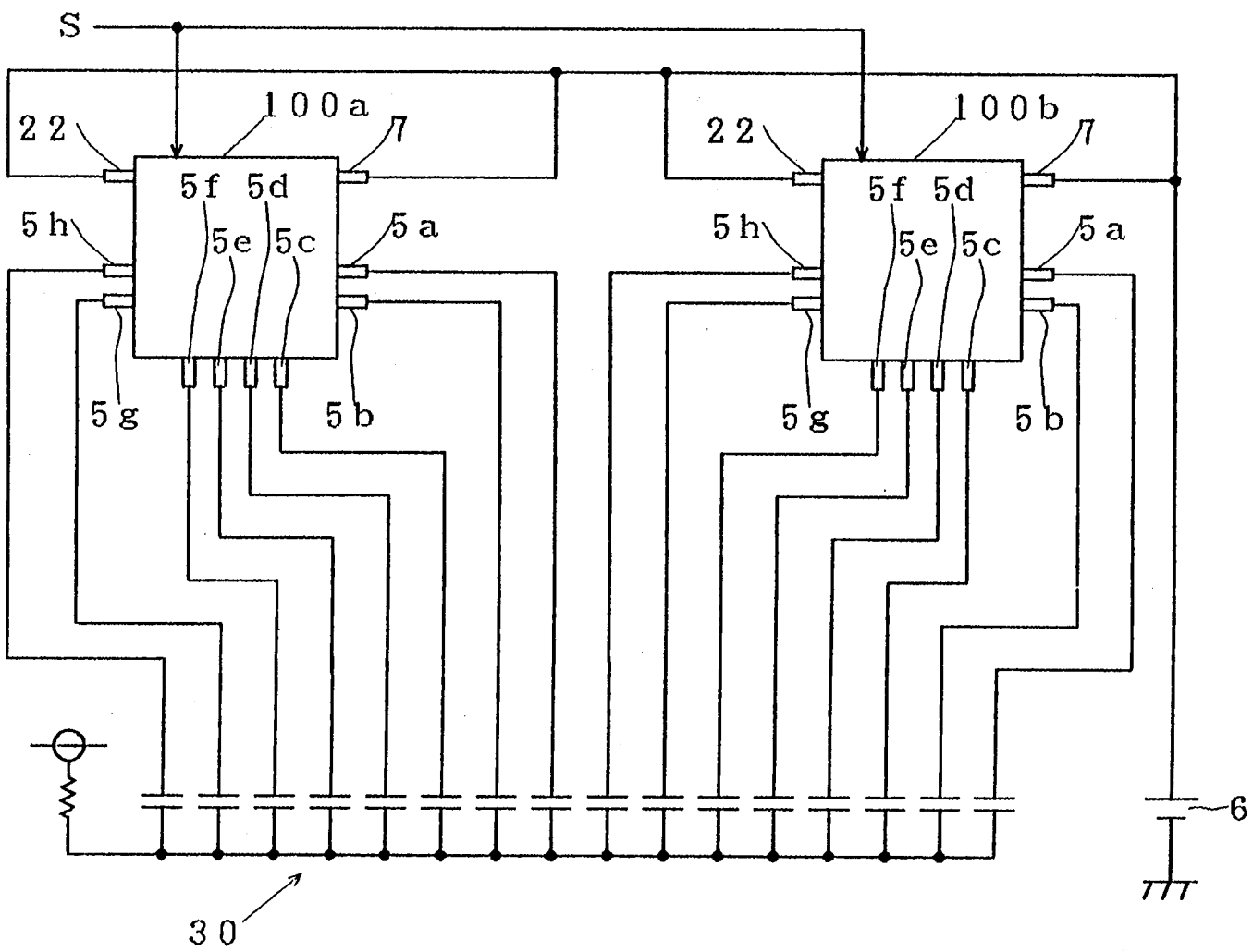

FIG. 10 is a circuitry diagram of a capacity loaded circuit which is equivalent to the liquid crystal display element 30 which comprises the segment electrode group 31 which is connected in such a manner as that shown in FIG. 9. The display quality of the liquid crystal display element 30 is in inverse proportion to a product of the output impedance of a circuit which drives the liquid crystal display element 30 and an equivalent capacitance. Here, since the segment electrode group 31 is driven by the semiconductor integrated circuits 100*a* and 100*b* and differences in the output impedance between the drive signal output terminals 5*a*, 5*b*, . . . , 5*h* of the semiconductor integrated circuits 100*a* and 100*b* are reduced as described earlier in relation to the first preferred embodiment, differences in the product of the output impedance and the equivalent capacitance among the segment electrodes 31*a*, 31*b*, . . . , 31*h* are also suppressed. As a result, the display quality of the liquid crystal display as a whole is improved.

Figure 11:
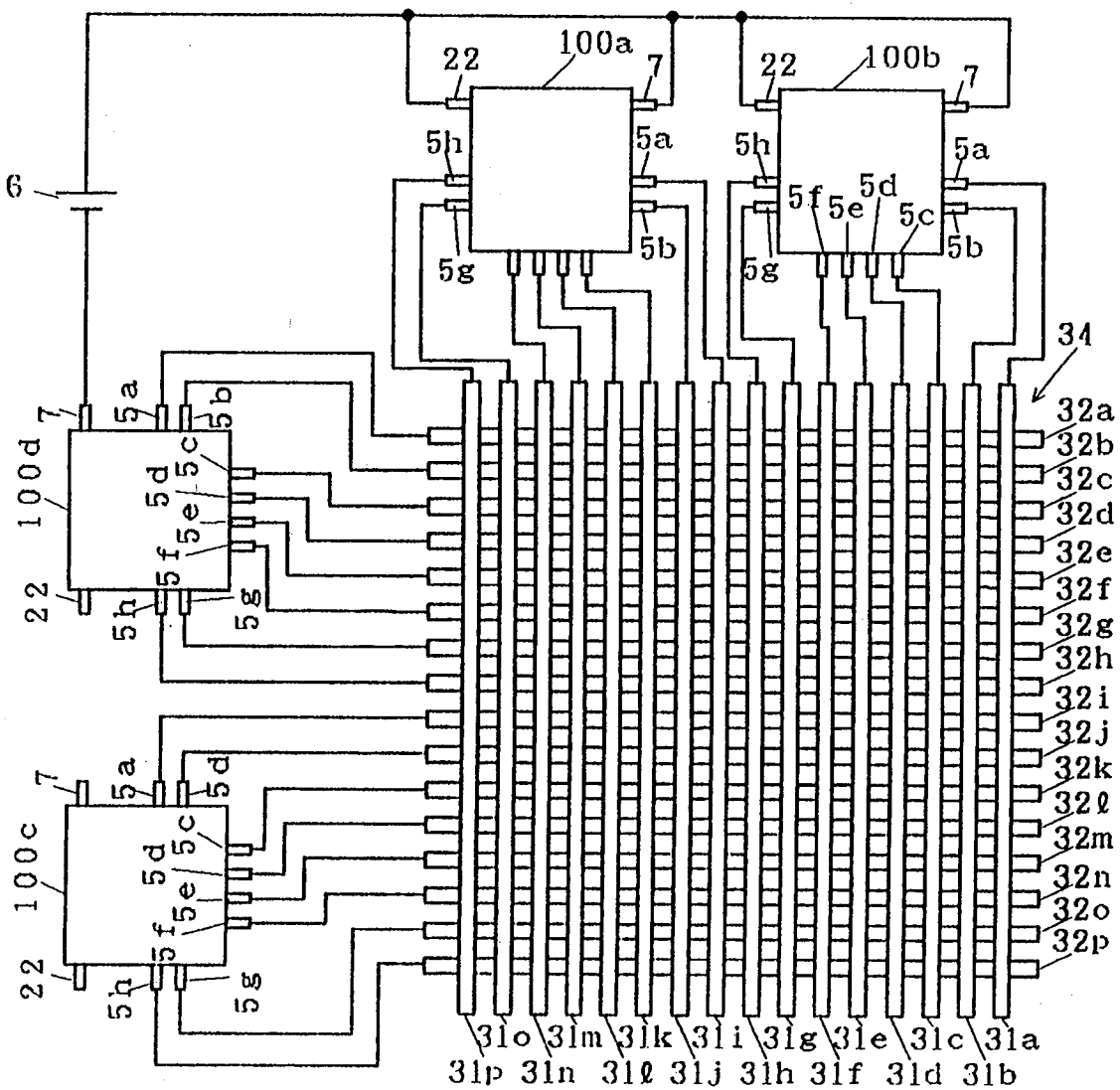
Figure 12:
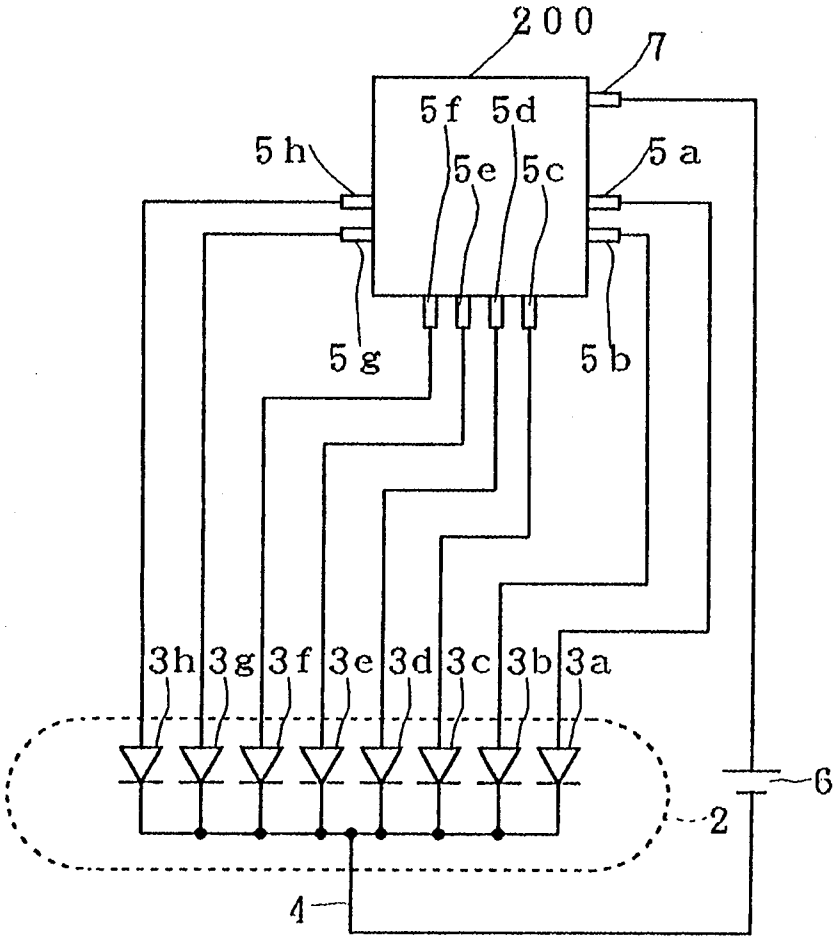
FIG. 12 PRIOR ART
FIG. 12 is a circuitry diagram showing a conventional technique.
Figure 13:
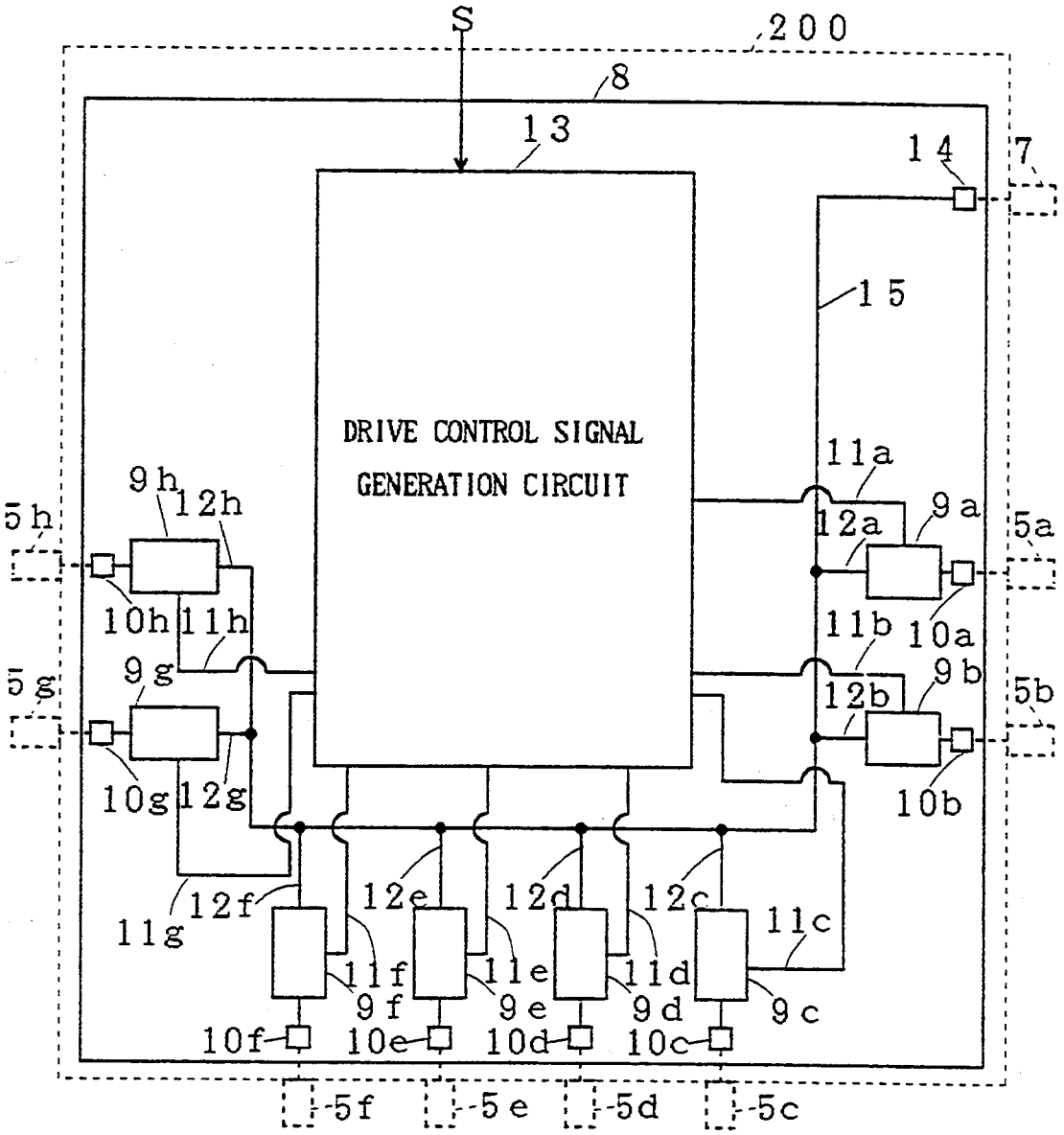
FIG. 13 PRIOR ART
FIGS. 13 and 14 are block diagrams showing the conventional technique.

It is needless to mention that the present invention is applicable to a common electrode drive circuit. FIG. 11 is a circuitry diagram showing where the segment electrode group 31 is driven by the semiconductor integrated circuits 100*a* and 100*b* and the common electrode group 32 as well is driven by semiconductor integrated circuits 100*c* and 100*d*. The semiconductor integrated circuits 100*c* and 100*d* are each identical in structure to the semiconductor integrated circuit 100, including the feature that the cathode of the drive power source 6 is connected to the drive power source terminal 7.

The common electrode group 32 consists of common electrodes 32*a*, 32*b*, . . . , 32*p*. The common electrodes 32*a*, 32*b*, . . . , 32*h* are connected to the drive signal output terminals 5*a*, 5*b*, . . . , 5*h* of the semiconductor integrated circuit 100*d* so that the potentials at the common electrodes 32*a*, 32*b*, . . . , 32*h* are controlled. The common electrodes 32*i*, 32*j*, . . . , 32*p* are connected to the drive signal output terminals 5*a*, 5*b*, . . . , 5*h* of the semiconductor integrated circuit 100*c* so that the potentials at the common electrodes 32*i*, 32*j*, . . . , 32*p* are controlled.

In a liquid crystal display 34 which comprises the common electrode group 32 which is connected in such a manner, at both the segment electrodes and the common electrodes, differences in the output impedance between the semiconductor integrated circuits which drive the segment electrodes and the common electrodes are reduced. Hence, compared with the example of FIG. 10, a better display quality is obtained.

While the invention has been described in detail, the foregoing description is in all aspects illustrative and not restrictive. It is understood that numerous other modifications and variations can be devised without departing from the scope of the invention.

I claim:

1. A semiconductor integrated circuit comprising:

(a) one or more pairs of power source terminals each comprising first and second power source terminals which are at the same potential;

(b) a plurality of output terminals;

(c) one or more power source lines for connecting a respective pair of said power source terminals directly to each other;

(d) a plurality of drive circuits respectively coupled to said plurality of output terminals, said drive circuits each having one or more input terminals and output terminals, the number of input terminals of each drive circuit being equal to the number of drive power source lines, said drive circuits each receiving at least one drive control signal which controls a connection between said one or more input terminals and output terminals of each of said drive circuits; and (e) a drive control signal generation circuit for receiving a control signal and providing said drive control signal to said drive circuits in accordance with said control signal, wherein said one or more input terminals of said drive circuits are connected at predetermined intervals to each of said one or more drive power source lines.

2. The semiconductor integrated circuit according to claim 1, wherein said drive circuits each include a transistor which comprises:

(d-1) a first current electrode which is connected to said input terminal of each of said drive circuits;

(d-2) a second current electrode which is connected to said output terminal of each of said drive circuits and (d-3) a control electrode for receiving said drive control signal.

3. The semiconductor integrated circuit according to claim 1, wherein said drive power source line has:

(c-1) a first length between said first power source terminal and a plurality of contact points which is closest to said first power source terminal, said contact points being points at which said input terminals of said drive circuits are connected to said drive power source line;

(c-2) a second length between said second power source terminal and a contact point which is closest to said second power source terminal, and wherein (c-3) a difference between Said first and said second lengths is not more than 100 μm.

4. The semiconductor integrated circuit according to claim 1 which comprises a plurality of pairs of power source terminals.

5. The semiconductor integrated circuit according to claim 4, wherein the number of control signals output to each drive circuit is equal to the number of drive power source lines.

6. A display apparatus comprising:

(a) a plurality of semiconductor integrated circuits each comprising:

(a-1) one or more pairs of power source terminals each comprising first and second power source terminals which are at the same potential, (a-2) a plurality of output terminals, (a-3) one or more power source lines for connecting a respective pair of said power source terminals directly to each other, (a-4) a plurality of drive circuits respectively coupled to said plurality of output terminals, said drive circuits each having one or more input terminals and output terminals, the number of input terminals of each drive circuit being equal to the number of drive power source lines, said drive circuits each receiving at least one drive control signal which controls a connection between said one or more input terminals and output terminals of each drive circuit, and (a-5) a drive control signal generation circuit for receiving a control signal and providing said drive control signal to said drive circuits in accordance with said drive control signal, wherein in each of said semiconductor integrated circuits, said one or more input terminals of said drive circuits are connected at predetermined intervals to said one or more drive power source lines;

(b) an array of display elements, the number of said display elements being greater than the number of said output terminals of each semiconductor integrated circuit, each of said display elements having first and second terminals and operating in response to a potential difference between said first and second terminals; and (c) a voltage source having first and second terminals, said first and second power source terminals being connected in common to said first terminal of said voltage source, said second terminals of said display elements being connected in common to said second terminal of said voltage source.

7. The display apparatus according to claim 6, wherein there is only a single voltage source, and said first and second power source terminals of each semiconductor integrated circuit is connected in common to said first terminal of said voltage source.

8. The display apparatus according to claim 7, wherein one of said output terminals of a first one of said semiconductor integrated circuits which is closest to said first power source terminal of said first one of said semiconductor integrated circuits and one of said output terminals of a second one of said semiconductor integrated circuits which is closest to said second power source terminal of said second one of said semiconductor integrated circuits are connected to said first terminals of two adjacent display elements of said display elements, respectively.

9. A display apparatus comprising:

(a) a plurality of first semiconductor integrated circuits each comprising:

(a-1) one or more pairs of power source terminals each comprising first and second power source terminals which are at the same potential, (a-2) a plurality of output terminals, (a-3) one or more power source lines for connecting a respective pair of said first and second power source terminals directly to each other, (a-4) a plurality of drive circuits respectively coupled to said plurality of output terminals, said drive circuits each having one or more input terminals and output terminals, the number of input terminals of each drive circuit being equal to the number of drive power source lines, said drive circuits each receiving at least one drive control signal which controls a connection between said one or more input terminals and output terminals of each of said drive circuits, and (a-5) a drive control signal generation circuit for receiving a control signal and providing said drive control signal to said drive circuits in accordance with said control signal, wherein in each of said semiconductor integrated circuits, said one or more input terminals of said drive circuits are connected at predetermined intervals to said one or more drive power source lines;

(b) a display element having first and second terminals which operates in response to a potential difference between said first and second terminals, the number of second terminals being greater than the number of said output terminals of one of said first semiconductor integrated circuits;

(c) a voltage source having first and second terminals, said first and second power source terminals of said first semiconductor integrated circuits being connected in common to said first terminal of said voltage source; and (d) an electrode drive circuit connected to said second terminal of said voltage source, said electrode drive circuit controlling a potential which is output to said first terminal of said display element, wherein said first terminals of said display element are exclusively connected to said output terminals of said first semiconductor integrated circuits.

10. The display apparatus according to claim 9, further comprising (e) a plurality of second semiconductor integrated circuits each comprising:

(e-1) one or more pairs of power source terminals each comprising first and second power source terminals;

(e-2) a plurality of output terminals;

(e-3) one or more power source lines for connecting respective pairs of first and second power source terminals to each other;

(e-4) a plurality of drive circuits coupled to respective ones of said output terminals, said drive circuits each having one or more input terminals and output terminals, the number of input terminals of each drive circuit being equal to the number of drive power source lines, said drive circuits each receiving at least one drive control signal which controls a connection between said one or more input terminals and output terminals of each drive circuit; and (e-5) a drive control signal generation circuit for receiving a control signal and providing said drive control signal to said drive circuits in accordance with said control signal, wherein in each of said semiconductor integrated circuits, said one or more input terminals of said drive circuits are connected at predetermined intervals to said one or more drive power source lines, and the number of second terminals of said display element is greater than the number of output terminals of one of said second semiconductor integrated circuits, and said second terminals of said display element are exclusively connected to said output terminals of said second semiconductor integrated circuits.

* * * * *